United States Patent [19]

Reif et al.

[11] 4,338,186

[45] Jul. 6, 1982

[54] SHALE OIL PROCESS

[75] Inventors: Henry E. Reif, Bryn Mawr; Jeffrey P. Schwedock, Aston, both of Pa.

[73] Assignee: Suntech, Inc., Philadelphia, Pa.

[21] Appl. No.: 207,537

[22] Filed: Nov. 17, 1980

[51] Int. Cl.[3] ..... C10G 65/04; C10G 65/12; C10G 67/08

[52] U.S. Cl. ..... 208/89; 208/90; 208/211; 208/213; 208/254 H

[58] Field of Search ..... 208/211, 213, 254 H, 208/89, 90

[56] References Cited

U.S. PATENT DOCUMENTS

| | | | |
|---|---|---|---|
| 2,966,450 | 12/1960 | Kimberlin et al. | 208/254 H |
| 2,988,501 | 6/1961 | Inwood | 208/211 |
| 3,159,564 | 12/1964 | Kelley et al. | 208/89 |
| 3,655,551 | 4/1972 | Hass et al. | 208/89 |
| 4,231,858 | 11/1980 | Seitzer et al. | 208/254 H |
| 4,261,813 | 4/1981 | Smith | 208/254 H |

OTHER PUBLICATIONS

"RDS and VRDS Hydrotreating", *Hydrocarbon Processing,* Sep. 1978, p. 148.

"VGO and DAO Hydrotreating", *Hydrocarbon Processing,* Sep. 1978, p. 156.

*Primary Examiner*—Delbert E. Gantz
*Assistant Examiner*—O. Chaudhuri
*Attorney, Agent, or Firm*—J. Edward Hess; Donald R. Johnson; Paul Lipsitz

[57] ABSTRACT

A process for converting the raffinate from an HCl-treated shale oil to a suitable feedstock for a hydrocracking reactor for making fuels from the raffinate by hydrotreating the raffinate and thereafter water quenching the hydrotreated product.

4 Claims, 1 Drawing Figure

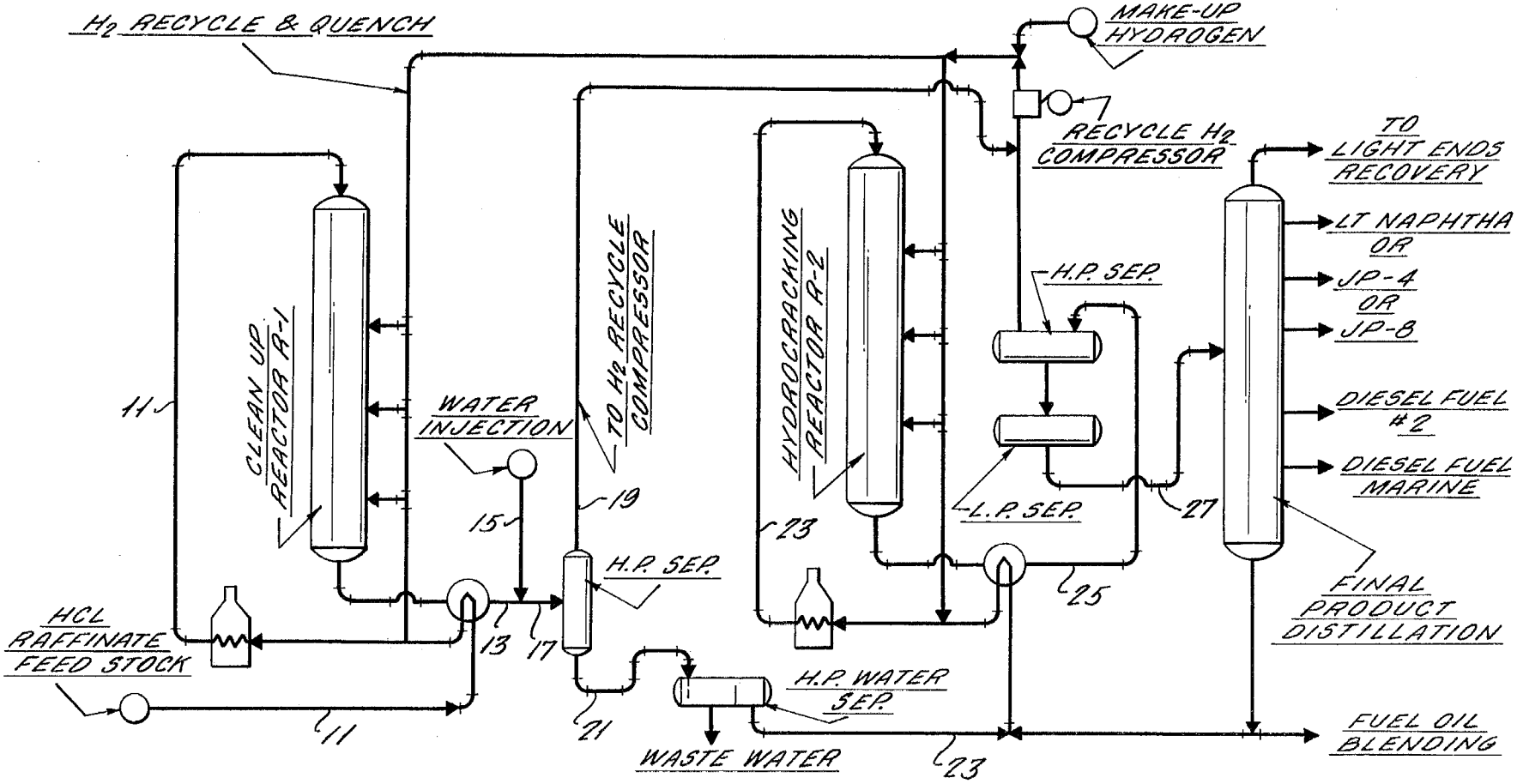
TO LIGHT ENDS RECOVERY
LT NAPHTHA OR JP-4 OR JP-8
DIESEL FUEL #2
DIESEL FUEL MARINE
FINAL PRODUCT DISTILLATION
FUEL OIL BLENDING
MAKE-UP HYDROGEN
RECYCLE H2 COMPRESSOR
H.P. SEP.
L.P. SEP.
27
25
23
HYDROCRACKING REACTOR R-2
H.P. WATER SEP.
WASTE WATER
TO H2 RECYCLE COMPRESSOR
19
H.P. SEP.
21
17
WATER INJECTION
15
13
H2 RECYCLE & QUENCH
CLEAN UP REACTOR R-1
11
HCL RAFFINATE FEED STOCK

SHALE OIL PROCESS

This invention relates to a method for processing an intermediate shale oil product for use as a feedstock to a hydrocracking unit from which hydrocarbon fuels such as aviation turbine fuels (e.g., jet fuels) are obtained. It is known as disclosed in U.S. Pat. No. 4,231,858 (which is hereby incorporated by reference) to catalytically hydrogenate whole crude shale oil under severe conditions of temperature and pressure to convert the neutral nitrogen compounds in the oil to hydrocarbons, ammonia, and basic nitrogen compounds, separate the treated shale oil and then contact the separated oil with anhydrous hydrogen chloride. After separating off the nitrogen salts which are formed, the liquid hydrocarbon product is treated with sulfuric acid or clay to remove any remaining nitrogen materials and the liquid is then distilled and/or hydrocracked to obtain jet fuel products.

It is, of course, also known in the art to treat conventional refinery streams with water. For example in the hydrotreating step described in *Hydrocarbon Processing* September 1978, page 148, sulfur, nitrogen aslphaltene and metal contaminants are removed from residual stocks, and in subsequent processing water is used to clean the hydrogen recycle gas. Similarly at page 156 of the same journal high sulfur content gas oils are desulfurized by hydrotreating and a subsequent water wash is used on the recycle stream.

The process of this invention provides a novel and improved method for treating the HCl-treated shale oil in order to remove undesired contaminants still present. For example, it has been found that the shale oil raffinate separated after the HCl-treating step still contains some organic sulfur and nitrogen compounds, as well as some residual chlorine. As is known, sulfur and nitrogen compounds will poison the catalyst used in the subsequent hydrocracking step. In a hydrotreater employed as a clean-up reactor these materials are converted to ammonia, hydrogen sulfide and ammonium chloride. It has been found that the solid ammonium chloride present separates out and plugs the lines of the processing units and the sulfur and nitrogen compounds, as indicated, are catalyst poisons. In accord with the invention, a process is provided for preparing a feedstock from HCl-treated shale oil for a hydrocracking reactor which is free of the contaminating sulfur and nitrogen compound materials and this is done by first hydrotreating the raffinate from the HCl-treated shale oil and thereafter water quenching the hydrotreated product before feeding it to the hydrocracker.

Reference is now made to the drawing which will be used to illustrate the process.

A raffinate feedstock stream (11) from the HCl treatment is fed into a hydrotreater clean-up reactor (R-1) where nitrogen components are reduced to no more than about 30 parts per million and sulfur components, generally as hydrogen sulfide, are also removed. The hydrotreating step involves a typical hydrotreating catalyst such as nickel-molybdenum catalyst and is generally carried out at about 690° to about 710° F. and at about 1600 to about 1700 psi. Table I indicates the general operating conditions used in R-1 for jet and other fuels.

TABLE I

| OPERATING CONDITIONS FOR CLEAN-UP REACTOR (R-1) | |
|---|---|
| REACTOR OPERATING CONDITIONS: | |
| LHSV. VOL/HR/VOL. | 1 |
| AVERAGE CATALYST TEMP., °F. | 690–710 |
| TOTAL PRESSURE (PSI) | 1600–1700 |
| HYDROGEN CONSUMPTION, SCF/B | |
| CHEMICAL | 550–600 |
| CATALYST | Ni—Mo |
| FEEDSTOCK CHARACTERIZATION | |
| TBP BOILING RANGE, °F. | 490–1000 |
| API GRAVITY | 30.3–32.5 |
| TOTAL NITROGEN, PPM | 700–750 |

The reaction product stream (13) from R-1 is subjected to a water quench by injection of water (15) as shown in the drawing and the quenched product (line 17) is subjected to a high pressure separation step from which hydrogen gas is recycled to a compressor (stream 19) and the liquid product (stream 21) taken to a high pressure water separation step as shown, the waste water being sent to a waste water treatment plant. The liquid product from this separation (line 23) contains, in general, less than 30 ppm of nitrogen and is a very desirable feedstock for hydrocracking in that it has no significant detrimental effect on the hydrocracking catalyst. Also, because ammonium chloride is removed from the stream, no plugging of the lines will occur. The typical characteristics of the treated product (stream 23) fed to the hydrocracker (R-2) are shown in Table II.

TABLE II

| Characteristics Of Feed To Hydrocracker (R-2) | |
|---|---|
| TBP Boiling Range °F. | 380–1000 |
| API Gravity | 31.3–33.5 |
| Total Nitrogen, PPM | <1–30 |
| Sulfur, PPM | <1–10 |

The typical hydrocracking conditions for conversion of the HCl-treated and water-quenched feed are shown in Table III.

TABLE III

| Hydrocracking Conditions For R-2 | |
|---|---|
| LHSV, VOL/HR/VOL | 2 |
| Avg. Catalyst Temp. °F. | 710–740 |
| Total Pressure, PSI | 1600–1700 |
| Hydrogen Consumption, SCF/B | |
| Chemical | 900–1100 |
| Conversion, Vol % FRESH FEED | 50–70 |

The products from the hydrocracker (stream 25) are fed to appropriate high and low pressure separators and then (stream 27) to a final product distillation column which yields the fuel products as shown in the drawing.

As a result of the process of the invention very high yields of jet fuel products of high quality are obtained. Typical characteristics of these products are shown in Table IV.

TABLE IV

PRODUCT CHARACTERISTICS

| CHEMICAL AND PHYSICAL TEST DATA | JP-4 | JP-8 | Gasoline Blend Stock | #2 Diesel Fuel |
|---|---|---|---|---|
| API @ 60° F. | 50.9 | 42.9 | 71.0 | 38.0 |
| DISTILLATION, °F. | | | | |

TABLE IV-continued

PRODUCT CHARACTERISTICS

| CHEMICAL AND PHYSICAL TEST DATA | JP-4 | JP-8 | Gasoline Blend Stock | #2 Diesel Fuel |
|---|---|---|---|---|
| (ASTM-) | D 2887 | D 2887 | D-86 | D-86 |
| INITIAL | 158 | 210 | 50 | 450 |
| 10 Vol. % | — | 310 | 145 | 480 |
| 20 Vol. % | 260 | 352 | 170 | 495 |
| 50 Vol. % | 342 | 410 | 202 | 535 |
| 90 Vol. % | 459 | 510 | 240 | 590 |
| END POINT | 527 | 560 | 290 | 650 |
| AROMATICS, % | 15 | 16 | 3 | 24 |
| OLEFINS, Vol. % | 1 | 2 | 1 | — |
| MERCAPTANS, Wt. % | 0.0001 | 0.0003 | — | — |
| SULFUR, Wt. % | 0.0003 | 0.0002 | NA | 0.0011 |
| NITROGEN (TOTAL), ppm | 3 | 3 | 1 | 3 |
| FLASH, °F. | — | 110 | — | 210 |
| FREEZE PT., °F. | −80 | −70 | −82 | −10 |
| NET HT. OF COMB., BTU/LB | 18,764 | 18,610 | 19,050 | 18,730 |
| $H_2$ CONTENT, Wt. % | 14.16 | 13.85 | NA | NA |

The process of the invention also enables the hydrocracker catalyst to be used for long periods since it is not adversely affected by any poisons in the feed stream. Thus, the overall fuels manufacturing process is made more efficient and of greater commercial value.

The invention claimed is:

1. A process for preparing hydrocarbon aviation fuels from a raffinate of an HCl-treated shale oil which comprises hydrotreating said raffinate, removing ammonium chloride by water quenching the hydrotreated bottoms liquid product, separating hydrocracker feed consisting of said water-quenched stream which is essentially free of sulfur and nitrogen materials, hydrocracking said separated stream and distilling said hydrocarbon fuels from said hydrocracked product.

2. A process for preparing hydrocarbon aviation fuels from a raffinate of an HCl-treated shale oil which comprises hydrotreating said raffinate in the presence of a hydrotreating catalyst at a temperature of from about 690° to about 710° F. and at about 1600 to 1700 psi, thereafter removing ammonium chloride by water quenching the hydrotreated bottoms liquid product, separating a hydrocracker feed consisting of said water-quenched stream which is essentially free of sulfur and nitrogen materials, hydrocracking said separated stream and distilling said hydrocarbon fuels from said hydrocracked product.

3. The process of claim 2 wherein the HCl-treated shale oil is derived from a whole crude shale oil.

4. The process of claim 3 wherein the fuel prepared is an aviation turbine fuel.

* * * * *